United States Patent [19]

Morris et al.

[11] Patent Number: 4,827,089

[45] Date of Patent: May 2, 1989

[54] MOLDED CASE CIRCUIT BREAKER INTERLOCK ARRANGEMENT

[75] Inventors: Robert A. Morris, Burlington; Roger N. Castonguay, Terryville, both of Conn.

[73] Assignee: General Electric Company, New York, N.Y.

[21] Appl. No.: 205,894

[22] Filed: Jun. 13, 1988

[51] Int. Cl.[4] ..... H01H 9/26

[52] U.S. Cl. ..... 200/50 C

[58] Field of Search ..... 200/50 C; 335/8, 10, 335/159, 160, 161; 307/64, 80; 361/343

[56] References Cited

U.S. PATENT DOCUMENTS

| | | | |
|---|---|---|---|
| 3,312,797 | 4/1967 | Harrington et al. | 200/50 C |
| 3,319,020 | 5/1967 | Shaffer | 200/50 C |
| 3,647,997 | 3/1972 | Nerem | 200/50 C |
| 3,705,280 | 12/1972 | Harms | 200/50 C |
| 3,710,288 | 1/1973 | Grunert | 335/160 |
| 3,778,633 | 12/1973 | DeVisser et al. | 307/64 |
| 4,286,242 | 8/1981 | Mrenna et al. | 335/160 |
| 4,295,053 | 10/1981 | Kovatch et al. | 307/64 |
| 4,295,054 | 10/1981 | Kovatch et al. | 307/80 |
| 4,499,344 | 2/1985 | Castonguay et al. | 200/50 C |
| 4,733,211 | 3/1988 | Castonguay et al. | 335/192 |
| 4,754,247 | 6/1988 | Raymont et al. | 335/202 |

OTHER PUBLICATIONS

Ser. No. 061,244 entitled "Molded Case Circuit Breaker Accessory Enclosure", Raymont et al., filed 6/12/87.

*Primary Examiner*—J. R. Scott

*Attorney, Agent, or Firm*—Richard A. Menelly; Walter C. Bernkopf; Fred Jacob

[57] ABSTRACT

Molded case circuit breakers connected to two different sources of power within an industrial application are interlocked to prevent one circuit breaker from being turned on while the other circuit breaker is already on. The circuit breakers include a molded plastic crossbar arranged for rotation within the circuit breaker enclosure. The interlock arrangement consists of a pivoted bell crank assembly including a pair of pivotally mounted insulative posts on either end of the bell crank. A corresponding cam integrally formed on the circuit breaker crossbar is in interference with one of the upstanding posts when the circuit breaker is in the "OFF" position and is out of interference with the upstanding post when the circuit breaker is in its "ON" condition.

8 Claims, 3 Drawing Sheets

MOLDED CASE CIRCUIT BREAKER INTERLOCK ARRANGEMENT

BACKGROUND OF THE INVENTION

When electrical equipment is arranged for alternate connection between two sources of power such as with a standard power system and with an auxiliary or emergency power system, an interlock arrangement is employed to prevent both power sources from being simultaneously connected to the equipment.

The following U.S. Pat. Nos., namely, 3,319,020; 3,312,797; 3,647,997; and 3,705,280, are representative of interlock arrangements for various rated circuit breakers and electric switches.

U.S. Pat. No. 3,778,633 entitled "Automatic Electric Power Source Transfer Apparatus" describes a "walkingbeam" interlocking mechanism consisting of a bell crank lever arrangement with a pivotally mounted post at each end of the bell crank. The post extends through openings in the bottom of the circuit breaker case to interact with the circuit breaker movable contact arm.

U.S. Pat. No. 4,499,344 entitled "Interlock Arrangement for Circuit Breaker Compartments" describes a complex mechanical interconnection between large ampere-rated circuit breakers mounted within separate compartments.

One purpose of the instant invention is to describe a simple and inexpensive interlock arrangement for molded case circuit breakers of the type utilizing a molded plastic crossbar assembly.

SUMMARY OF THE INVENTION

The invention comprises the combination of a bell crank interlock assembly with a pair of molded case circuit breakers including molded plastic crossbar assemblies. The crossbar assemblies include integrally formed yokes for supporting the movable contact arms and integrally formed barriers for electrically isolating the contact arms. An opening through the bottom of the circuit breaker case subjacent the integrally formed barriers allows an insulative post mounted on the interlock assembly to interact with the barriers.

DESCRIPTION OF THE PREFERRED EMBODIMENT

Figure 1:
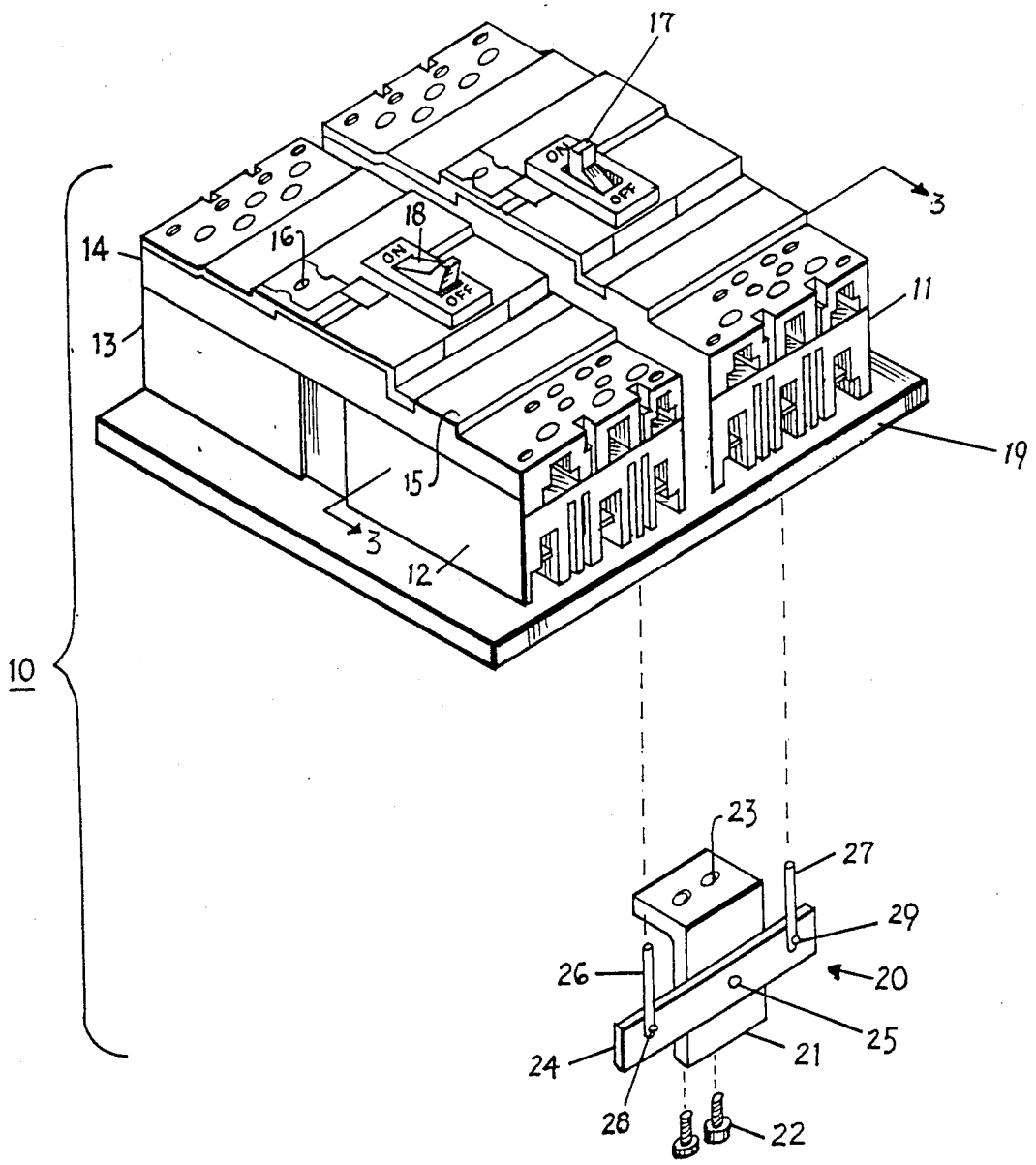
FIG. 1 is a top perspective view of a pair of molded case integrated protection units mounted on a panelboard with a bell crank interlock assembly in isometric projection therefrom.

Integrated protection units 11, 12 each of which consist of a case 13, cover 14 and integrated accessory cover 15 are attached to a panelboard 19. A rating plug 16 inserted within a top surface of the accessory cover 15 sets the ampere rating of the integrated protection units. The integrated protection units are described within U.S. patent application Ser. No. 061,244 filed June 12, 1987 now U.S. Pat. No. 4,754,247 and entitled "Molded Case Circuit Breaker Accessory Enclosure".

For purposes of this disclosure, an integrated protection unit is one that provides both overcurrent protection along with at least one accessory function. When the protection units are interlocked to form an interlocked assembly 10 such that the operating handle 17 on one of the circuit protection units 11 is in the "ON" position, the operating handle 18 of the other circuit protection unit, such as 12, must remain in the "OFF" condition. This insures that two separate power sources will not be connected to the same power distribution system, at the same time. To prevent such occurrence, a "walkingbeam" interlock mechanism 20, such as described within the aforementioned U.S. Pat. No. 3,778,633 is attached to the panelboard by fastening a pair of screws 22 through corresponding thru-holes 23 formed in the support bracket 21. The interlock mechanism is in the form of a bell crank lever 24 which is pivotally attached to the bracket by means of a pivot pin 25 and a pair of upstanding insulative posts 26, 27 which are pivotally attached at opposite ends of the bell crank lever by means of pivot pins 28, 29. Often times the installation of such an interlock mechanism must be installed at the point of manufacture in order to retain the appropriate electric code approvals.

Figure 2:
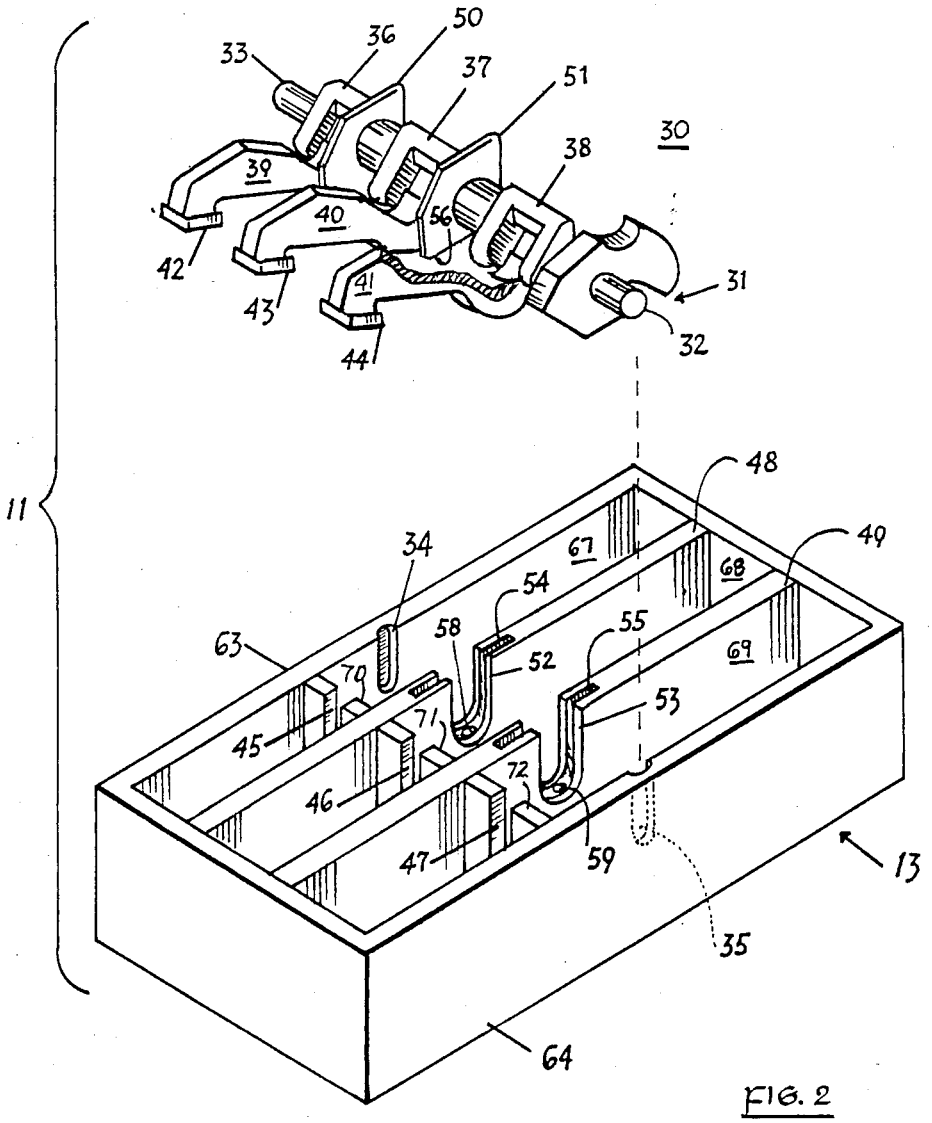
FIG. 2 is a top perspective view of the integrated protection unit of FIG. 1 with the cover removed and with the crossbar assembly in isometric projection therefrom.

Before discussing the operation of the interlock mechanism 20, it is helpful to describe the mounting relationship between the crossbar assembly 30 and the circuit breaker case 13 for the integrated protection unit 11 as seen by now referring to FIG. 2. The crossbar assembly includes a molded plastic crossbar 31 similar to that described within U.S. Pat. No. 4,733,211, which Patent is incorporated herein for purposes of reference. The crossbar 31 is mounted within the case by insertion of integrally formed pins 32, 33 extending from the ends of the crossbar within complementary slots 34, 35 formed within the outer side walls 63, 64 of the case. As described in the aforementioned U.S. Pat. No. 4,733,211, which describes a current limiting circuit breaker, the crossbar includes three yokes 36–38 integrally formed therein which support three corresponding movable contact arms 39–41, the movable contact arms are arranged to move independently of the crossbar upon the occurrence of a short circuit condition in any one of the individual phase circuits to which the circuit breaker is connected. The use of the contact arms as a means of interlocking between adjoining circuit breakers as described within aforementioned U.S. Pat. No. 4,499,344 is therefore non-feasible in current limiting circuit breakers. Movable contacts 42–44 are attached to the ends of the movable contact arms furthest from the crossbar. To rotatably support the crossbar within the case and to electrically isolate the movable contact arms, a pair of rotatable baffles 50, 51 are integrally formed therein. The rotatable baffles are received within corresponding grooves 54, 55 that are formed within a pair of semi-circular slots 52, 53 that are formed in the inner side walls 48, 49. The rotatable baffles electrically isolate between the individual compartments 67–69 while the slots 45–47 through fixed baffles 70–72 formed within the compartments allow for the rotatable movement of the movable contact arms without allowing the gaseous by-products evolved during contact separation from entering the compartments. To accommodate the upstanding posts 26, 27, shown earlier in FIG. 1, a pair of thru-holes 58, 59 are formed through the bottom of the barrier support grooves 54, 55. Although only one such thru-hole is required, an additional thru-hole can be provided to vary the spacing between the interlocked protection units. A cam surface 56 integrally formed within the rotatable baffle 51 interacts with one of the upright posts 26, 27 to provide the interlock function. It is noted that the post 27 extends through the thru-hole 59 and interacts with the cam 56 formed on the rotatable baffle 51. The plastic material of the crossbar and the insulative material of the posts 26, 27 provides the required electrical isolation between the interior of the case 13 and the external environment in accordance with the requirements of the relevant electrical codes. The insulative properties of the crossbar alone are sufficient to allow the use of non-insulative posts, if so desired. This differs from the interlock arrangement described within the aforementioned U.S. Pat. No. 3,778,633 whereby the post on the interlock mechanism interacts with the movable contact arm.

Figure 3:
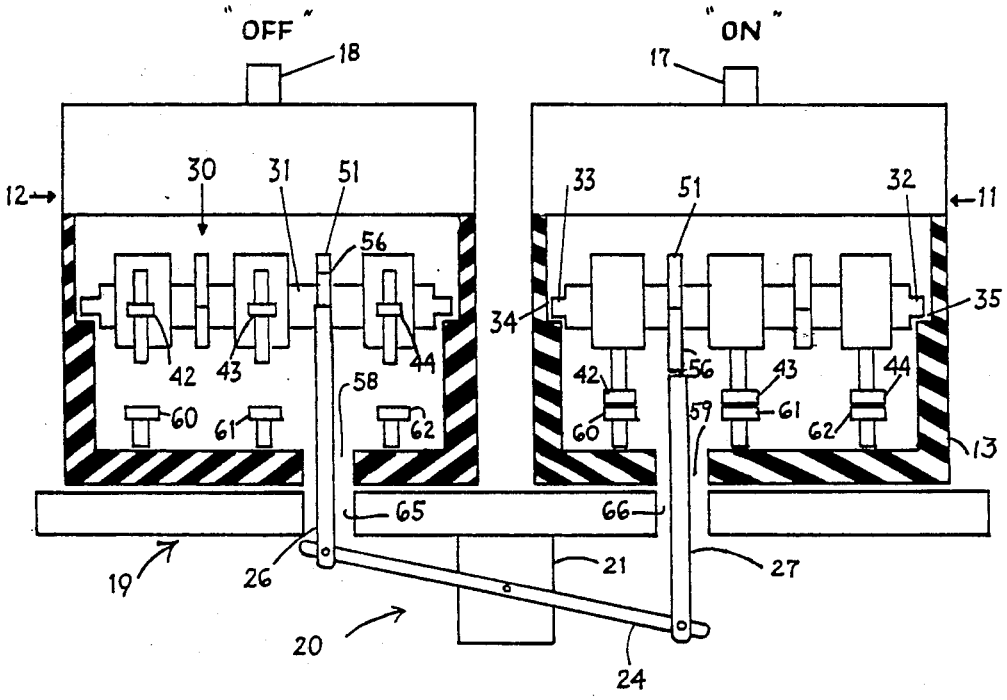
FIG. 3 is a front view, in partial section viewed through the plane 3—3, of the protection units of FIG. 1 interconnected in accordance with the invention.

The interaction between the crossbar assembly 30 and the interlock mechanism 20 is best seen by referring now to FIG. 3 wherein the integrated protection units 11, 12 are shown attached to the panelboard 19 with the interlock mechanism 20 attached to the bottom thereof by means of bracket 21. The insulative posts 26, 27 project through corresponding thru-holes 65, 66 formed in the bottom of the panelboard. The posts further extend through the thru-holes 58, 59 formed in the bottom of the integrated protection unit case 13. The crossbar assembly 30 is mounted within the integrated protection unit case by means of pins 32, 33 and slots 34, 35 as described earlier. In the integrated protection unit 11, having its operating handle 17 in the "ON" condition, the movable contacts 42–44 are in abutment with the fixed contacts 60–62 to complete the circuit through the integrated protection unit. The baffle 51 and the cam surface 56, integrally formed therein, are out of abutment with the top of the insulative post 27. The circuit protection unit 12 having its operating handle 18 in the "OFF" position is arranged such that the movable contacts 42–44 are out of abutment with the corresponding fixed contacts 60, 62 the insulative post 26 at the opposite end of the bell crank lever 24 is in abutment with the cam 56 on the corresponding baffle 51 to prevent the crossbar 31 from rotating and thereby prevent the movable contacts 42–44 from contacting the fixed contacts 60–62. Should an operator inadvertently attempt to close the contacts within the integrated protection unit 12, while the contacts within the integrated protection unit 11 are already closed, the operating handle 18 would be biased in the "OFF" position by virtue of the interference between the cam 56 and the top of the upright post 26.

The provision of the thru-holes 58, 59 through the bottom of the barrier support grooves 54, 55 (FIG. 2) allows the interlock mechanism to be field-installed at the site of the panelboard installation without interfering with the appropriate electric code approvals since the circuit breaker case and cover remain intact during the attachment of the interlock mechanism and no additional holes have to be formed through the bottom of the circuit breaker case.

A simple and inexpensive means for interlocking integrated protection units has herein been described. The use of a molded plastic crossbar in combination with insulative posts interconnected by a bell crank lever provides electrical isolation between the interior and exterior of the integrated protection units as herein described.

Having thus described my invention, what I claim as new and desire to secure by Letters Patent is:

1. A molded case circuit breaker comprising:

a molded plastic crossbar operatively controlled by an "ON-OFF" operating handle within a molded plastic case, said crossbar including at least one yoke integrally formed therein along with at least one baffle, said yoke pivotally supporting at least one corresponding movable contact arm having a movable contact on one end, said baffle being arranged for rotation within a corresponding groove formed within an interior wall integrally formed within said case; and at least one fixed contact mounted within said case and arranged for receiving said movable contact when said crossbar is in a closed position;

means formed within said groove for receiving a post, said post being arranged in a first position for interacting with said baffle to thereby prevent said crossbar and said movable contact from rotating to said closed position when said operating handle is in said "OFF" position and in a second position away from said baffle to allow said crossbar and said movable contact to rotate to said closed position when said operating handle is in said "ON" position.

2. The molded case circuit breaker of claim 1 including a pair of pins extending from opposite ends of said crossbar and being received within a pair of corresponding slots formed within opposing outer walls of said case for pivotally supporting said crossbar within said case.

3. The molded case circuit breaker of claim 1 wherein said means formed within said groove comprises a thru-hole, said post being arranged for moving back and forth within said thru-hole.

4. The molded case circuit breaker of claim 1 wherein said movable contact arm is arranged for rotation independent from said crossbar.

5. The molded case circuit breaker of claim 1 wherein said baffle includes cam-shaped surface to contact said post and to thereby drive said post away from said crossbar when said crossbar is being rotated to said closed position.

6. A pair interlocked circuit breakers comprising:

a first circuit breaker attached to a panelboard;

a first molded plastic crossbar rotatably mounted within said first circuit breaker and including a first movable contact arm having a first movable contact at one end and a first baffle, said first baffle being arranged within a first apertures groove integrally formed in a first interior wall within said first circuit breaker;

a first fixed contact mounted within said first circuit breaker and arranged for receiving said first movable contact when said first crossbar is rotated to a closed position;

a second molded case circuit breaker attached to said panelboard;

a second molded plastic crossbar rotatably mounted within said second circuit breaker and including a second movable contact arm having a second movable contact at one end and a second baffle, said second baffle being arranged within a second apertured groove integrally formed in a second interior wall within said second circuit breaker;

a second fixed contact mounted within said second circuit breaker and arranged for receiving said second movable contact with said second crossbar is rotated to said closed position; and an interlock mechanism comprising a bell crank lever attached to said panelboard, said bell crank lever including a first insulative post pivotally attached at one end and a second insulative post pivotally attached at an opposite end thereof said second post extending partly within said second circuit breaker and said first post extending partly within said first circuit breaker whereby said second crossbar is prevented from rotating said second movable contact into contact with said second fixed contact when said first movable contact is already in contact with said first fixed contact.

7. The pair of interlocked circuit breakers of claim 6 wherein said first insulative post is inserted within said first apertured groove and said second insulative post is inserted within said second apertured groove.

8. The pair of interlocked circuit breakers of claim 6 wherein said ball crank lever is attached to said panelboard by means of an apertured bracket.

* * * * *